United States Patent [19]

Muller

[11] Patent Number: 4,520,612

[45] Date of Patent: Jun. 4, 1985

[54] PACKAGING MACHINE

[75] Inventor: Rolf Muller, Longuich/Mosel, Fed. Rep. of Germany

[73] Assignee: The Mead Corporation, Dayton, Ohio

[21] Appl. No.: 462,163

[22] Filed: Jan. 31, 1983

[30] Foreign Application Priority Data

Jan. 15, 1982 [GB] United Kingdom ..... 8201078

[51] Int. Cl.[3] ..... B56B 11/10

[52] U.S. Cl. ..... 53/48; 72/481

[58] Field of Search ..... 53/48; 70/446, 448, 70/238, 239, 481; 74/16

[56] References Cited

U.S. PATENT DOCUMENTS

| | | | |
|---|---|---|---|
| 2,996,025 | 8/1961 | Georgeff | 72/446 |
| 3,430,413 | 3/1969 | Wood | 53/48 |
| 3,552,171 | 1/1971 | Shumaker | 72/239 |
| 3,572,003 | 3/1971 | Perry et al. | 53/48 |
| 4,301,673 | 11/1981 | Yonezawa | 72/448 |

*Primary Examiner*—Lowell A. Larson

*Attorney, Agent, or Firm*—Erwin Doerr

[57] ABSTRACT

The invention provides in a packaging machine, a locking device for securing together overlapping bottom panels of a wrapper wrapped about a group of articles, which device comprises tightening and locking components housed in a removable locking unit, said unit being movably mounted in the machine such that it can be moved transversely from a first operative position within the machine frame to a second non-operative position clear of the machine frame.

4 Claims, 3 Drawing Figures

PACKAGING MACHINE

This invention relates to a packaging machine which is constructed and operable to apply carton wrappers of the so-called wrap-around type, around selected groups of bottles in order to form multi-packs. The invention more particularly is concerned with a locking device incorporated in the machine for tightening and locking such wrappers about the bottles and which readily can be withdrawn from the machine. The device can be modified for use with various sized wrappers whilst withdrawn and then speedily repositioned in the machine, thus permitting a fast change-over from one type of packing operation to another.

The invention provides in a packaging machine, a locking device for securing together overlapping bottom panels of a wrapper wrapped about a group of articles, which device comprises tightening and locking components housed in a removable locking unit, said unit being movably mounted in the machine such that it can be withdrawn transversely from a first operative position within the machine frame to a second non-operative position clear of the machine frame.

Figure 1:
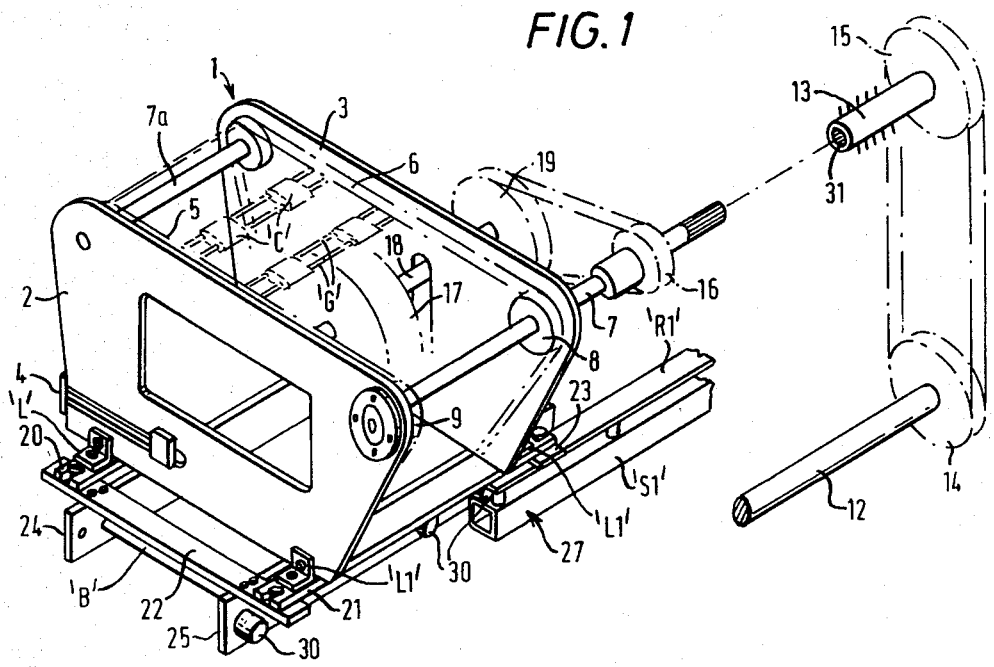
Figure 2:
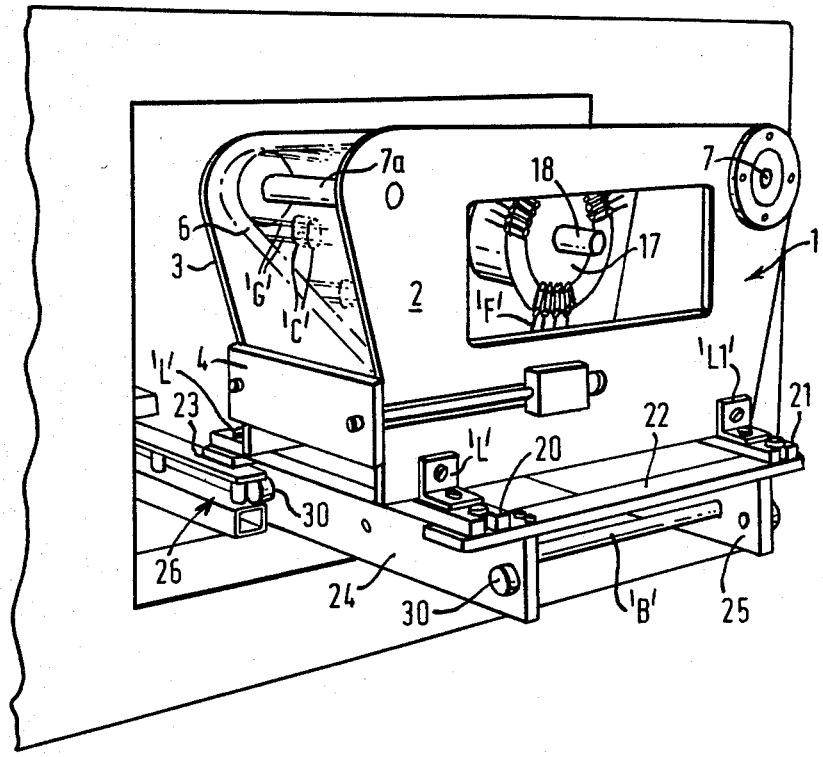
Figure 3:
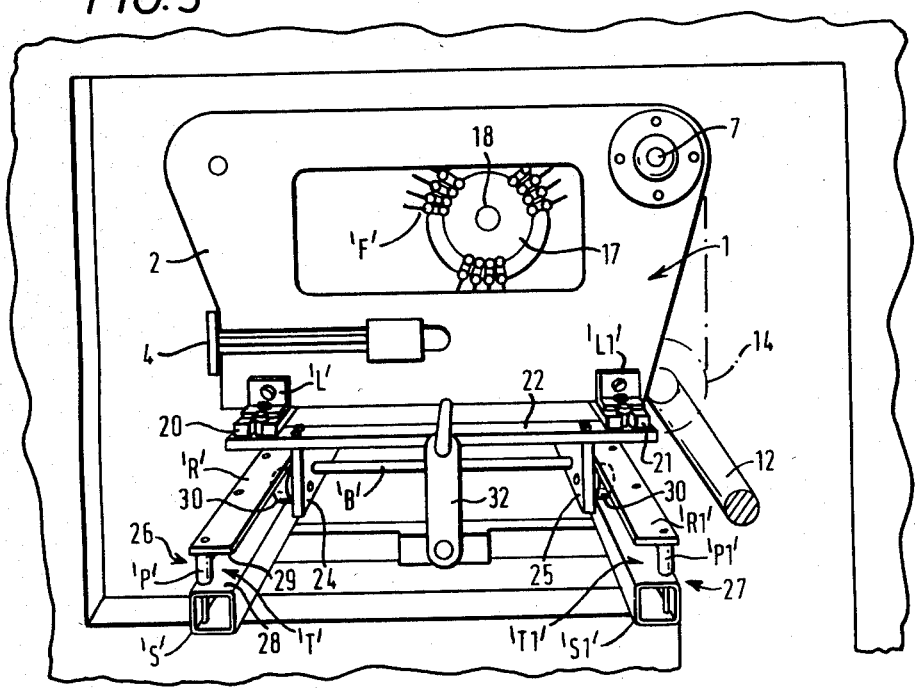

An embodiment of the invention will now be described, by way of example, with reference to the accompanying drawings, in which:

FIG. 1 is a schematic perspective view of the device according to the invention, FIG. 2 is a perspective view of the device after having been slidably removed from the machine into its non-operative position, and FIG. 3 is a perspective view of the device within the machine frame and located in its operative position.

Referring to the drawings, the locking device comprises a movable locking 'table' 1 which includes a pair of spaced, interconnected flank plates 2, 3 respectively between which the main wrapper tightening and locking components are housed.

These components and their operation are know per se, and do not form the subject of the present invention. A similar construction, in simplified form, is shown and described in U.S. Pat. No. 4,243,143 owned by the applicant for the present invention.

The flank plates 2, 3 are interconnected by an end plate 4 and a number of transverse shafts for transmitting drive to the tightening and locking components. The transverse shafts are journalled in the flank plates and each shaft carries a sprocket at each of its ends located adjacent the juxtaposed faces of the flank plates. Thus, a pair of chain sets 5, 6 (FIG. 1) are provided for imparting motion to the tightening components of the device. For example, shaft 7 carries sprockets 8, 9 which mesh with the links of chain sets 5, 6 respectively. The remaining shafts and sprockets appropriately are located to guide the chain sets in their respective paths of movement. The chain sets carry a series of guide-rod pairs 'G' on each of which is mounted tightening hooks or cams 'c' for engagement with apertures provided in the bottom panels of a wrapper. In operation, the chains revolve continuously and they carry a filled wrapper with them which is tightened about the bottles ready for locking, as disclosed in the specification of the aforementioned patent. Drive is transmitted to shaft 7 from the main outfeed driveshaft 12 of the machine which rotates intermediate shaft 13 journalled on the machine frame via sprockets 14 and 15 respectively (FIG. 1). A further chain and sprocket drive incorporating a sprocket 16 carried by shaft 7 drives a locking wheel 17 located intermediate flank plates 2 and 3. Locking wheel 17 is mounted on one end of transverse shaft 18 which carries driven sprocket 19 at its opposite end. The locking wheel 17 includes one or more sets of adjustably mounted locking fingers 'F' which, in use, punch a locking tab through a locking aperture in the wrapper.

The flank plates 2, 3 together with the housed components forms the table unit 1 which readily can be withdrawn from and replaced in the machine as will become apparent.

The table unit 1 releasably is bolted onto spaced cross bars 20, 21 respectively, by means of angled lugs 'L', '$L_1$' and the cross-bars are interconnected at each of their ends by cross-members 22, 23 respectively. The cross-members are secured to transverse runner plates 24, 25 respectively, which are interconnected by a series of tie-bars 'B'.

A pair of spaced guide rail structures 26, 27 are mounted within the machine structure for cooperation with the runner plates and each guide rail structure comprises a hollow square-section support 'S' above which is mounted a retaining bar 'R'. For example, guide rail structure 26 comprises support 'S' and retaining bar 'R'. Bar 'R' is connected to support 'S' by a series of spaced bolts or pins 'P' which are positioned so as to leave a clear track 'T' between the top surface 28 of support 'S' and the superposed undersurface 29 of retaining bar 'R'. The runner plates 24, 25 are positioned to slide adjacent the space between the guide rail structures. To this end each runner plate is provided with a number of spaced studs 30 which engage within tracks 'T', '$T_1$' whereby each runner plate can slide relative to the associated guide rail structure in order to withdraw the table unit 1 from the machine frame.

In use, the table unit 1 is located within the machine frame so that the tightening and locking components of the unit are positioned for cooperation with the filled wrapper blanks. In this operative position the shaft 7 is keyed within a hollow end section 31 of intermediate drive shaft 13 so that drive is transmitted to the unit. A pivotable locking clamp 32 (FIG. 3) is engaged to secure the table unit in its operative position. When it is desired to remove the table unit from the machine, the locking clamp 32 is released and the table withdrawn from the machine frame whereby the runner plates slide relative to the guide structures. As the table unit is withdrawn, shaft 7 automatically disengages from the hollow end section 31 of intermediate shaft 13 whereby drive to the unit is disconnected.

The table unit is shown in its operative position in FIG. 3 and in its withdrawn position in FIGS. 1 and 2. When withdrawn, maintenance work or adjustment may be made to the tightening and/or locking components of the table. Alternatively, the table may be detached from the transverse bars 20, 21 by detaching the lugs 'L', '$L_1$' and removed completely to enable a second table having different locking finger settings to be substituted.

Suitable stop means may be provided to prevent the guide rails from being withdrawn from their associated guide rails.

I claim:

1. In a packaging machine for applying a wrapper to a group of articles whereby overlapping portions of the wrapper are tightened and secured together by tightening and locking elements, a removable locking unit mounted in the machine on transversely extending guide rails so that it can be withdrawn as a unit transversely of the machine from a first operative position within the machine frame to a second non-operative position clear of the machine frame, said unit comprising a housing which contains said tightening and locking elements arranged in operative relationship, runner plates supporting said housing and slidingly engaging said guide rails, a releasable drive coupling for engaging drive means of the machine when said locking unit is in said first operative position so that drive is transmitted to said tightening and locking elements and for automatically disengaging said drive means of the machine when the locking unit is withdrawn to said second non-operative position so that drive to said tightening and locking elements is disconnected, and releasable locking means for securing said locking unit in said first operative position.

2. A packaging machine according to claim 1, further characterized in that each of said runner plates includes a plurality of stud members (30) which engage within tracks ('T') provided by respective ones of said guide rail structures whereby the runner plates can slide relative to said guide rail structures.

3. A packaging machine according to claim 2, further characterized in that each of said guide rail structures comprises a support 'S' extending transversely of the machine frame and a retaining bar 'R' connected to said support so as to leave a clear track between a top surface of said support and an undersurface of said retaining bar in which track one of said runner plates is slidingly engaged.

4. A packaging machine according to claim 3, further characterized in that said support and said retaining bar are connected together by a series of spaced pins ('P').

* * * * *